United States Patent [19]

Weigl et al.

[11] 4,170,371

[45] Oct. 9, 1979

[54] SKI BINDING PART

[75] Inventors: Erwin Weigl, Brunn am Gebirge; Alois Himmetsberger, Vienna, both of Austria

[73] Assignee: TMC Corporation, Baar, Switzerland

[21] Appl. No.: 880,082

[22] Filed: Feb. 22, 1978

[30] Foreign Application Priority Data

Feb. 23, 1977 [AT] Austria ..... 1211/77

[51] Int. Cl.[2] ..... A63C 9/08

[52] U.S. Cl. ..... 280/625

[58] Field of Search ..... 280/625, 626, 627, 628, 280/629, 630

[56] References Cited

U.S. PATENT DOCUMENTS

| | | | |
|---|---|---|---|
| 3,806,143 | 4/1974 | Wyss | 280/625 |
| 3,902,730 | 9/1975 | Tschida et al. | 280/625 |
| 4,088,343 | 5/1978 | Krob | 280/625 |

*Primary Examiner*—Robert R. Song

*Attorney, Agent, or Firm*—Blanchard, Flynn, Thiel, Boutell & Tanis

[57] ABSTRACT

A ski binding wherein the sole holding members are pivotally secured to a carriage movable forwardly and rearwardly on the upper surface of a ski. The carriage is locked to a base plate fixedly secured to the ski. A movement of the ski boot toward the ski boot release position relative to the sole holding members initiates an unlocking of the carriage from the base plate so that the entire carriage, including the sole holding members, is shifted away from the ski boot to facilitate a release of the ski boot from engagement with the ski. Upon release of the ski boot from the ski, the sole holding members are returned to their initial sole holding position and, simultaneously therewith, the carriage is returned and locked to the base plate.

17 Claims, 8 Drawing Figures

SKI BINDING PART

FIELD OF THE INVENTION

The invention relates to a ski binding part having symmetrically arranged two-arm sole holders, which are pivotal about axles arranged perpendicularly with respect to the running surface of a ski and which each rest with one arm on the boot and with a second arm on a structural part which is under the action of a spring and is supported adjustably in the binding housing.

BACKGROUND OF THE INVENTION

A ski binding part is known having swingable levers which rest both with their ends and also with a roller provided thereon on the sole of the ski boot. The sole holders are not toggle levers, but further levers are arranged on the axles of the rollers, the other common hinge point of which is connected to a spring. A disadvantage of this construction is that adjustment of the normal position of the levers to various ski boot soles is not possible.

Also a ski binding part has already been suggested, which has two two-arm sole holders pivotal about ski-fixed axles and rest with each one arm on the boot sole. On the second arm of each sole holder at the front edge thereof, there is provided a recess for forming a locking receptacle, in which engages a spring-loaded locking element in the form of a support roller. The support rollers are carried by two levers, which are supported pivotally on a common eccentric axis which is arranged perpendicularly with respect to the ski and are under the action of a leaf spring package. The horizontal spacing between the support rollers can be varied by rotation of the eccentric axis, which causes the sole holders to be pivoted for adjustment to various ski boot forms. However, in the case of such an adjustment by means of the eccentric axis, the engagement of the support rollers in the locking recesses changes and the point of application of the spring package on the levers carrying the support rollers is also changed. Thus at an adjustment and thus at various boot shapes different release moments are obtained. Furthermore, this device is very complicated due to the many parts and is also expensive and therefore also easily susceptible to trouble.

It is furthermore also known to support the ski binding part directly on a carriage which is adjustable in longitudinal direction of the ski and a resilient pin is supported in the movable carriage, which pin engages a notch in the base plate. The pin rests in the locking position on a surface of the ski binding part. This causes at a certain swing of the ski binding part the carriage to be released and to be moved forwardly, so that the ski boot is released totally and without friction by the sole holders. A disadvantage of this solution consists on the one hand in the binding having to be returned manually into the initial position after the release operation, furthermore, the unlocking operation of the locking pin is possible only by using an additional spring and the spring force must be overcome during a closing of the binding. For the purpose of a positive unlocking, the spring may not be weakly dimensioned. Then, however, in particular under difficult snow and slope conditions, readjustment of the binding into the ready position (for stepping in) is complicated.

Therefore, the purpose of the invention is to provide a ski binding part movably freely forwardly after a certain swinging of the sole holder and after the ski boot is released the ski binding part is returned automatically into the initial position and is locked in said initial position.

The purpose of the invention is attained by the second arms of the sole holders being held between one end of a spindle which is arranged in the housing and extends in longitudinal direction of the ski and on which a bent end of a slide member is secured and a bent end on a movable carriage, which carriage, as actually known, carries the ski binding part and can be moved along a base plate fixed to a ski. A lock is arranged in the ski binding part and can engage or disengage from a notch in the base plate. The lock rests on the side of the bent section of the carriage, remote from the second arms, and said carriage can be moved up and down along a limited path controlled at least in one direction by the slide member, and by a resilient fork means anchored to the base plate and operatively connected to a part of the carriage, which part extends substantially parallel to the base plate.

A mechanism has been able to be created with the inventive measure for assuring after the release operation has taken place both an automatic return of the ski binding part into the initial position and also an automatic locking of the carriage in said initial position.

According to a preferred embodiment of the invention, the lock can be positively controlled by the slide member at least in direction of unlocking by a frictional connection and/or form locking connection therebetween. This creates a positive release without requiring additional structural parts.

In the locking direction of the lock, the lock can engage through its own weight. However, it is more advantageous, if inventively the lock is loaded either by a spring or is forcedly controlled by a control element on the slide member.

According to a further thought of the invention, the part of the slide member which extends in longitudinal direction of the ski and which lies substantially parallel to the base plate or the carriage can have at least one part, as for example an edge, a stop or the like. This produces a particularly simple positive control for the unlocking operation.

According to a different thought of the invention, the resilient fork means can be secured with the interpositioning of a holding part on the underside of the carriage, the holding part being bent and having openings therein for receiving the legs of the fork and including springs arranged on the legs of the forks. This structural part can be easily exchanged, if needed, for example if new springs should be needed, or if a return with altered spring characteristics is desired.

Furthermore it is possible in a ski binding part of the above-mentioned type, which preferably has also one or several characteristics of the aforementioned thoughts of the invention, to use a measure wherein the second arms of the sole holders engage comblike or side-by-side over one another in the area of the slide member against which they engage. This measure can, as mentioned, be used not only in the case of a ski binding part, which permits a shifting forwardly; it can also be used in other ski binding parts which were mentioned hereinabove. As a result, a centered guide is achieved, without creating—like in other similar ski binding parts—an undesired torque acting against the return force. Thus the action of the return spring can be better utilized, or if the force reduced by the torque would be sufficient, a smaller return spring can be used.

BRIEF DESCRIPTION OF THE DRAWINGS

Further advantages and details of the invention will now be described more in detail with reference to the drawings which illustrate two exemplary embodiments.

In the drawings:

FIGS. 1 and 2 illustrate a first exemplary embodiment of the inventive ski binding part, wherein FIG. 1 is a longitudinal cross-sectional view taken along the line I—I of FIG. 2, and FIG. 2 is in the upper half thereof a cross-sectional view taken along the line II—II of FIG. 1 and in the lower half thereof a top view;

DETAILED DESCRIPTION

Figure 1:
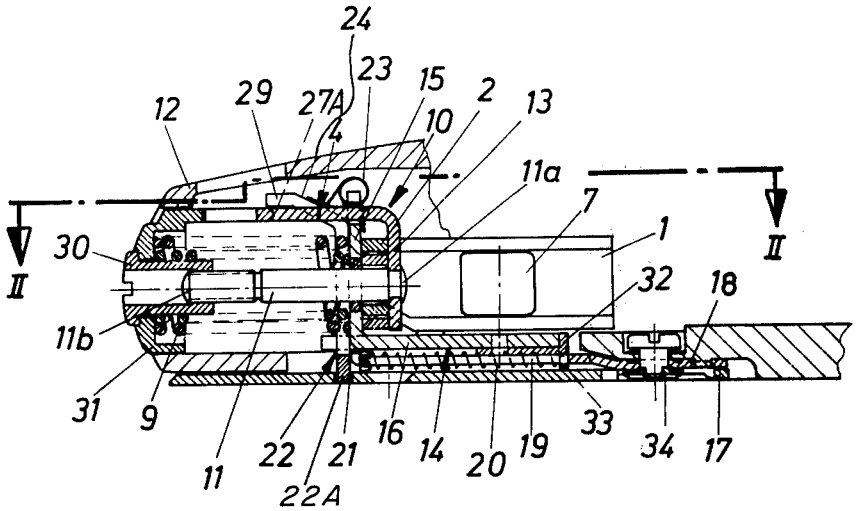
Figure 2:
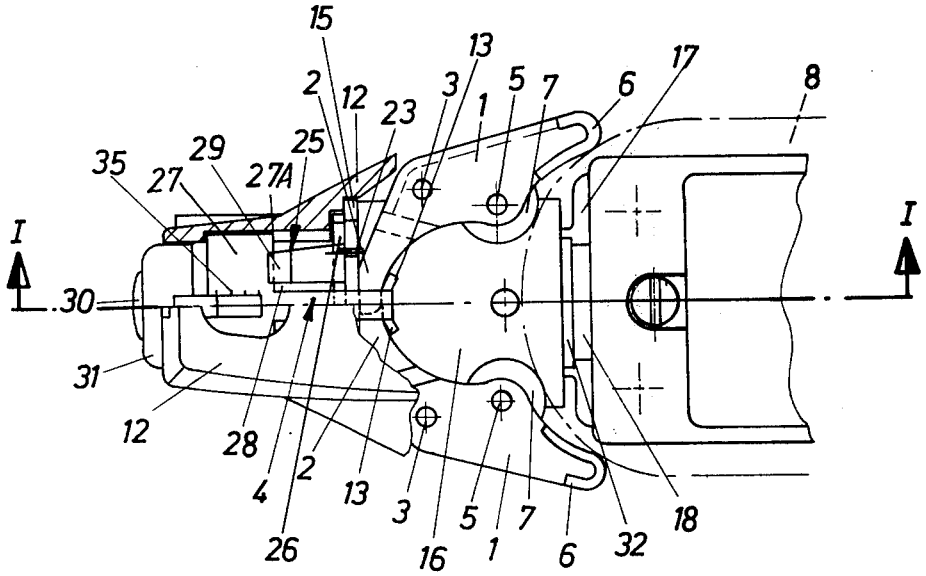

As can be taken from FIGS. 1 and 2, two two-arm toggle-leverlike sole holders 1, 2 are pivotally supported about pivot axles 3 secured to a carriage 14. The sole holders 1, 2 each support on their first arms 1 which face the ski boot 8, indicated only by dashed lines, an approximately vertical shaft 5 on which rollers 7 are rotatably supported. An insert 6 is furthermore secured to each of the arms 1, which insert is constructed as a slider for engaging and supporting the toe area of the ski boot 8.

The second arms 2 of the sole holders 1, 2 are received in a recess formed by a bent section or flange 15 on the carriage 14 and a bent section or flange 13 on a structural part which functions as a slide member 10. The slide member 10 or its bent section 13 is secured to one end 11*a* of a spindle 11 which extends in longitudinal direction of the ski forwardly away from the ski boot. The other end 11*b* of the spindle 11 has a thread thereon which is not identified in detail and is received in an adjusting nut 30. The adjusting nut is supported in a sleeve 31 which is supported longitudinally movably in the housing 12 of the ski binding part. A spring 9 encircles the spindle 11 and engages at one end the bent section 15 of the carriage 14 and at the other end the inside of the sleeve 31. Thus the second arms 2 of the sole holders 1, 2 are resiliently held between the two bent sections 13, 15.

Figure 5:
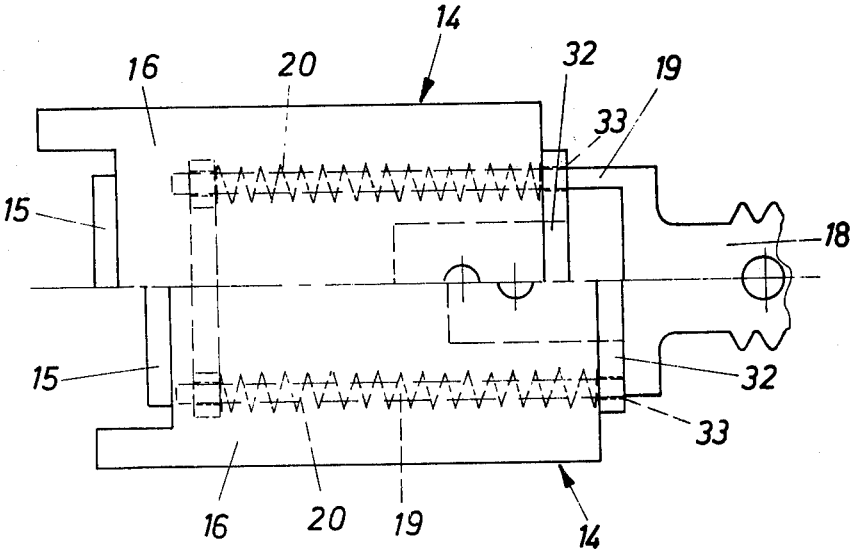
FIG. 5 illustrates a detail of a bifurcated member or fork which effects the return.

The carriage 14 is longitudinally movably supported and guided by a bifurcated member or fork 18 which will be described more in detail below. The fork 18 is in turn longitudinally adjustably mounted on a base plate 17 which is constructed as a guide rail, however, guided nonremovably vertically or perpendicular to the upper side of the ski. The fork 18 is secured to the base plate 17 by means of a releasable mounting device 34 or it can be anchored therein. Such releasable mountings are known to the average man skilled in the art; thus a further explanation is not needed. The carriage 14 has a part 16 which extends substantially parallel to the base plate 17. A holding part 32 is secured to the underside of the part 16. The holding part 32 is bent and has openings 33 therein for receiving the legs 19 of the fork 18 therethrough. Springs 20 encircle the legs 19 and extend between the holding part 32 and a collar-like device is secured to the free ends of the legs. As a result, the holding part 32 and attached carriage 14 are spring biased to the right as illustrated in FIG. 1. (For further details of the fork 18 see FIG. 5).

The base plate 17 has a notch 21 therein for receiving a lug 22A of a lock 22. The lock 22 is supported for vertical movement so that it can be disengaged from the notch. The ski binding part is, in the position illustrated in FIGS. 1 and 2, locked to the base plate 17 by engagement of the lug 22A of the lock 22 in the notch 21. Thus the ski boot 8 is held in a clamped-in or boot holding condition through the sole holders 1, 2 and through the not shown heel holder of any desired design on the (not illustrated) ski. The lock 22 is designed approximately U-shaped in a plane which extends perpendicular to the base plate 17 and the two legs 25 thereof extend upwardly first substantially parallel to the bent sections 15, then in the area or at the level of a control part 4 of the slide member 10, which control part 4 will be described in detail hereinbelow in a surface 24 which is inclined upwardly and away from the bent section 15, then terminates in end sections 29 which extend substantially parallel to the control part 4. The individual surfaces of the lock 22, particularly the end surfaces 29, are adapted to be undergripped by the parts 27 of the control part 4 of the slide member 10. The control part 4 is thereby designed as a section of the slide member 10 which extends substantially parallel to the base plate 17 or to the carriage 14 and has, as shown in a top view, an area (not identified in detail) which is tapered or necked down from the part 27 which grips under the ends 29 of the legs 25 toward the longitudinal axis of the ski binding part and is straddled on both lateral sides by the sections 26 of the lock 22.

Figure 8:
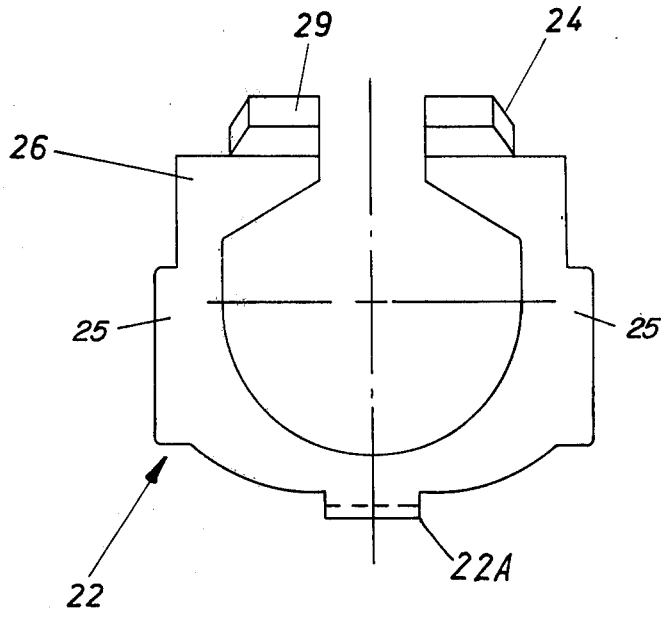
FIG. 8 is a front view of the lock.

In the area where the legs of the lock 22 are free of the underlying part 27 of the slide member 10 therebeneath, a lateral clearance 28 therebetween exits and on both sides of the slide member 10 and the lock 22. This will prevent a jamming. The upper sections 26 of the legs 25 taper inwardly so that the lock 22 generally encircles the spring 9. The control part 4 of the slide member 10 has at least one part 27A, as for example an edge, a stop or the like, which acts as a control element and grips under the ends sections 29 of the lock 22. In the present exemplary embodiment, the part which acts as a control element is constructed as an edge 27A. The lock 22 or the two laterally spaced sections 26 are engaged by torsion spring 23 mounted on the bent section 15 to urge the lock 22 downwardly relative to the carriage 14. As a result, the lug on the lock 22 will automatically move into the notch 21 after the return of the carriage 14 takes place—aside of the weight of the lock 22. It is easily understood from the drawings that the substantially U-shaped constructed lock 22 (FIG. 8) has in its area which faces the notch 21 (not illustrated in anymore detail) the aforementioned lug 22A. With this the lateral dimensions of the lock 22 can be reduced.

As can particularly well be recognized from FIG. 2, the second arms 2 of the sole holders 1, 2 overlap one another side-by-side. In this manner, a particularly good centering is achieved and this causes, as above-described, better power transmitting ratios for centering.

The slide member 10 has on its free end which is constructed as a control part 4 markings 35 for indicating control values of the initial tension of the spring 9. Such measures are known by themselves so that a further discussion of this detail is not needed. The sleeve 31 preferably has a square cross section with a smooth surface in the plane which lies perpendicular to the base plate 17, so that in the housing 12 there exists a low friction sliding of the sleeve 31 with respect thereto.

Figure 3:
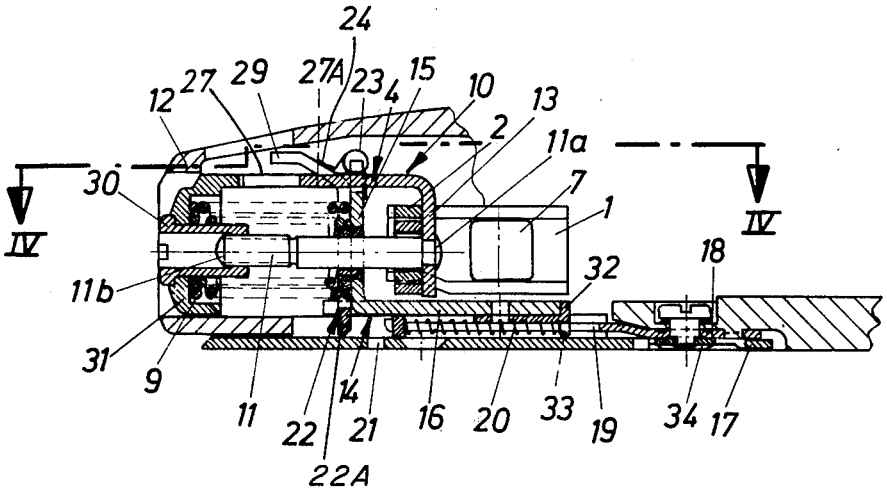
FIGS. 3 and 4 illustrate the ski binding part in a forwardly shifted position, similar to FIGS. 1 and 2.
Figure 4:
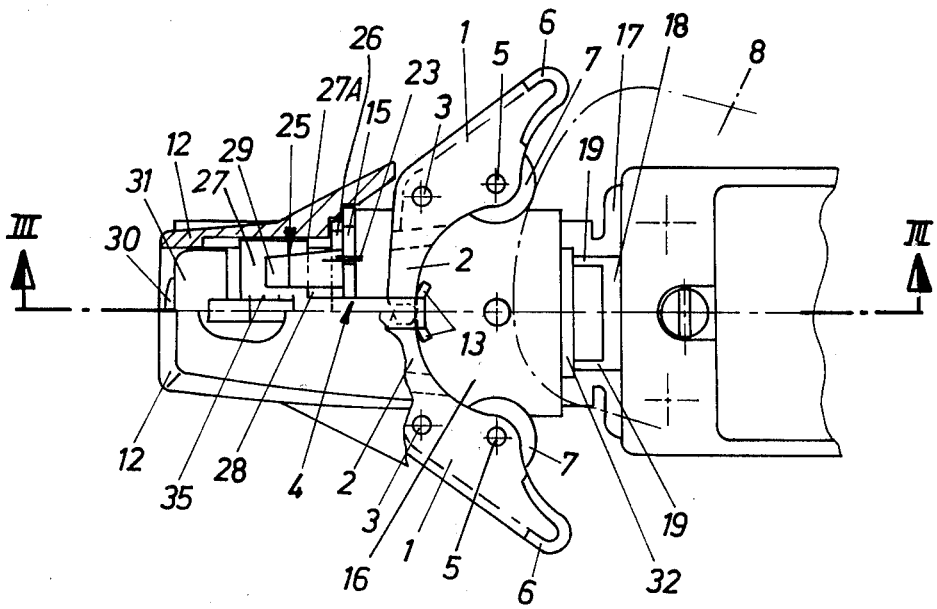
Figure 6:
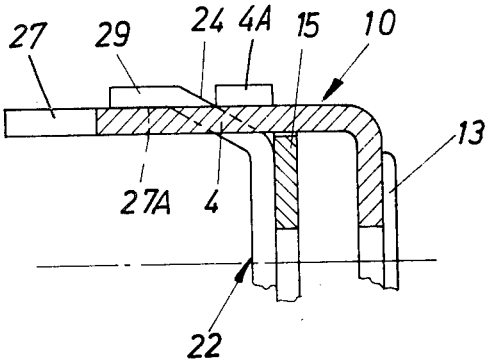
FIGS. 6 and 7 illustrate a modification of the control of the lock in partially sectioned side view and a top view, respectively.
Figure 7:
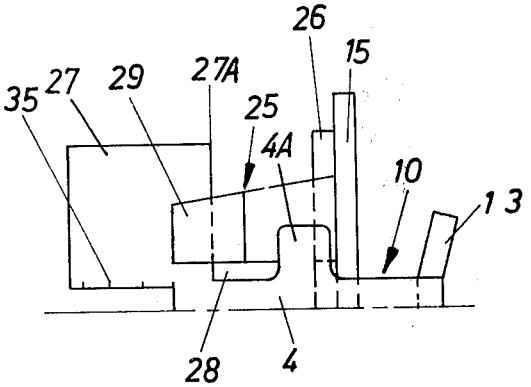

If a lateral force acts onto the sole holder 1, 2, then the second arms 2 are supported on the bent section 13, and the bent section 13 of the slide member 10 and the spindle 11 are moved against the force of the spring 9 in direction of the ski boot 8 (rearwardly). Thus the edge 27A, or the edges 27A, which act as the control element, is moved horizontally below and into engagement with the sloped surfaces 24 of the lock 22 and effect a lifting of the lock against the force of the spring 23 vertically upwardly, until the lug 22A of the lock 22 disengages from the notch 21 in the base plate 17. The entire ski binding part is immediately shifted forwardly as far as the carriage 14 is permitted to move on the base plate 17. This moves the sole holders 1, 2 away from the ski boot. Thus the ski boot 8 can swing out freely, after which the sole holders 1, 2, swing back into their initial position (ready position) due to the action of the spring 9 and, due to the action of the springs 20, the entire ski binding part is moved back into the ready position. As soon as the lug 22A on the lock 22 has reached the position of the notch 21, an automatic locking takes place. The released shifted position is illustrated in FIG. 3. FIGS. 6 and 7 illustrate a different embodiment for the controlled locking of the lock 22. This is similar to the forced control for unlocking in FIG. 1. The tab 4A, which engages the top of the section 24, pushes the lock 22 down when the spring 9 effects a return of the sole holders 1, 2 to the ready position following a release of the ski boot so that the lug 22A will enter the notch.

FIG. 6 shows the form of the lock 22 in a side view leaving out the further details.

The invention is not limited to the illustrated exemplary embodiments. Further modifications are conceivable, without departing from the scope of the invention. For example, both unlocking and also locking can be accomplished through a different forced control than through a spring element or through a control element. Pneumatic, hydraulic or mechanical translations are conceivable. Also returning the ski binding part can be done by pneumatic or hydraulic devices. It is important to the invention that both for the operation of the lock and also for the return of the entire ski binding part a forced control is provided and also for unlocking of the lock after reaching a predetermined swivelled position of the sole holders a forced control becomes active.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A releasable ski binding for use on a ski, comprising:

housing means secured to said ski;

first carriage means movably mounted on said housing means for movement between first and second positions along a path which extends parallel to the longitudinal axis of said ski;

a pair of ski boot engaging sole holders pivotally mounted on said first carriage means for movement about vertically extending axles and between a ski boot holding position and a ski boot releasing position, said sole holders being also movable along said path with said first carriage means;

second carriage means movably mounted on said housing means and relative to said first carriage means, said sole holders each having first means thereon engaging said second carriage means so that a movement of at least one of said sole holders about said axle therefor will effect a movement of said second carriage means relative to said first carriage means;

first resilient means extending between said first and second carriage means for resiliently biassing said second carriage means and said sole holders to said ski boot holding position thereof; and releasable locking means for releasably locking said first carriage means to said housing means in said first position thereof, said releasable locking means including control means responsive to a relative movement between said first and second carriage means caused by a turning of at least one of said sole holders about said axle therefor to effect a release of said locking relation between said housing means and said first carriage means whereby said first carriage means and said sole holders mounted thereon will move away from said first position and said ski boot under the force applied to at least one of said sole holders toward said second position.

2. The releasable ski binding according to claim 1, wherein said releasable locking means includes first means defining a notch in said housing means and a locking element supported for movement into and out of said notch, wherein said control means comprises operatively connected segments on said locking element and said carriage means, a relative movement between said operatively connected segments effecting said movement of said locking element into and out of said notch.

3. The releasable ski binding according to claim 2, wherein said locking means includes second resilient means for biassing said locking element into said notch.

4. The releasable ski binding according to claim 2, wherein said locking means includes second means constraining the movement of said locking element as a function of the relative position between said first and second carriage means.

5. The releasable ski binding according to claim 4, wherein said second means includes operatively connected first surfaces on said second carriage means and said locking element for effecting a movement of said locking element away from said notch in response to a relative movement of said first and second carriage means in a first direction and operatively connected second surfaces on said second carriage means and said locking element for effecting a movement of said locking element toward said notch in response to a relative movement of said first and second carriage means in an opposite second direction.

6. The releasable ski binding according to claim 2, wherein said control means includes a member on said second carriage means extending in the longitudinal direction of said ski and generally parallel to the upper surface of said ski, said member having a control surface engaging said segment on said locking element.

7. The releasable ski binding part according to claim 6, wherein said locking element is constructed substantially U-shaped in a plane which extends perpendicular to said longitudinal axis of said ski.

8. The releasable ski binding part according to claim 7, wherein the upwardly extending legs of said U-shaped locking element each have an extension which is inclined upwardly and away from the upper surface of said control surface, the ends of said extensions extending substantially parallel to said control surface which defines a support surface for said extensions and thereby said locking element.

9. The releasable ski binding according to claim 6, wherein said member is T-shaped and has a pair of laterally spaced control surfaces engaging laterally spaced segments on said locking element.

10. The releasable ski binding according to claim 9, wherein a clearance space is provided between the stem part of said T-shaped member and said laterally spaced segments.

11. The releasable ski binding part according to claim 1, wherein said first carriage means comprises a carriage, a guide element secured to said ski, said guide element having guide means thereon extending in a direction parallel to the longitudinal axis of said ski thereby defining said path, said carriage being mounted on said guide means for movement between said first and second positions, second resilient means for resiliently biassing said carriage toward said first position.

12. The releasable ski binding part according to claim 11, wherein said guide means includes a pair of parallel legs, said carriage having means defining guide holes receiving said legs therein.

13. The releasable ski binding part according to claim 12, wherein said second resilient means includes a pair of helical springs each encircling one of said legs, said springs engaging at one end a collar fixed to the free end of said legs and at the other end of said carriage.

14. The releasable ski binding part according to claim 1, wherein said housing means includes a base plate securable to said ski, said locking means comprising a notch in said base plate and a locking element supported for movement into and out of said notch, wherein said control means comprises operatively connected segments on said locking element and said second carriage means, a relative movement between said operatively connected segments effecting said movement of said locking element into and out of said notch.

15. The releasable ski binding part according to claim 14, wherein the end of said second carriage means which is remote from said sole holders has a square cross section, and wherein said housing has means defining an opening therein which has a square cross section slidably receiving said end of said second carriage means therein.

16. The releasable ski binding part according to claim 1, wherein said sole holders each have two interconnected angularly related arms intermediate the ends of which is located said vertically extending axle, one arm of said sole holder engaging said ski boot, the other arm engaging said second carriage means.

17. The releasable ski binding part according to claim 16, wherein said other arms of said sole holders have overlapping comblike segments in the area of said second carriage means on which they engage.

* * * * *

UNITED STATES PATENT AND TRADEMARK OFFICE

CERTIFICATE OF CORRECTION

PATENT NO. : 4 170 371

DATED : October 9, 1979

INVENTOR(S) : Erwin Weigl et al

It is certified that error appears in the above-identified patent and that said Letters Patent are hereby corrected as shown below:

Column 6, line 37; after "said", insert ---second---.

Signed and Sealed this

*Nineteenth* Day of *February 1980*

[SEAL]

*Attest:*

SIDNEY A. DIAMOND

*Attesting Officer*

*Commissioner of Patents and Trademarks*